US006665955B1

(12) United States Patent
Mizrahi et al.

(10) Patent No.: US 6,665,955 B1
(45) Date of Patent: Dec. 23, 2003

(54) FOOTWEAR SOLE AND METHOD FOR FORMING THE SAME

(75) Inventors: Charles Mizrahi, New York, NY (US); Xiaoming Yu, Shanghai (CN)

(73) Assignee: Wiesner Products, Inc., New York, NY (US)

( * ) Notice: Subject to any disclaimer, the term of this patent is extended or adjusted under 35 U.S.C. 154(b) by 0 days.

(21) Appl. No.: 09/717,944

(22) Filed: Nov. 21, 2000

(51) Int. Cl.[7] ..... A43B 1/02
(52) U.S. Cl. ..... 36/9 R; 36/14
(58) Field of Search ..... 36/9 R, 14; 12/146 B

(56) References Cited

U.S. PATENT DOCUMENTS 266,614 A * 10/1882 Douglas ..... 2/241
1,231,263 A 6/1917 Kelley
1,795,305 A 3/1931 Jacob
2,371,689 A * 3/1945 Gregg et al. ..... 36/30 R
2,391,564 A * 12/1945 Gregg ..... 36/30 R
3,800,445 A 4/1974 Greenblatt et al.
3,863,272 A * 2/1975 Guille ..... 2/239
3,930,275 A 1/1976 Bailin
4,294,022 A * 10/1981 Stockli et al. ..... 36/4
4,295,238 A 10/1981 Clark
4,571,851 A 2/1986 Yamada
4,852,272 A 8/1989 Chilewich et al.
4,858,337 A 8/1989 Barma
4,899,412 A 2/1990 Ganon
5,033,144 A 7/1991 Ganon
5,392,532 A 2/1995 Bray, Jr. et al.
5,491,860 A 2/1996 Bray et al.
5,515,566 A 5/1996 Ganon
5,617,585 A 4/1997 Fons et al.
5,746,014 A 5/1998 Tanemoto
5,983,527 A 11/1999 Strickland et al.
5,992,054 A 11/1999 Rauch
6,035,555 A 3/2000 Pavelescu et al.
6,430,844 B1 8/2002 Otis

* cited by examiner

*Primary Examiner*—Mickey Yu
*Assistant Examiner*—Troy Arnold
(74) *Attorney, Agent, or Firm*—Kenyon & Kenyon

(57) ABSTRACT

A footwear sole include a rubber inner sole and a textile outer sole. The textile outer sole is at least partially impregnated into at least one surface of the inner sole. A method of forming a footwear sole includes the steps of forming at least one inner sole and at least partially impregnating a textile material into at least a portion of at least one surface of the inner sole.

8 Claims, 4 Drawing Sheets

FOOTWEAR SOLE AND METHOD FOR FORMING THE SAME

FIELD OF THE INVENTION

The present invention relates generally to a footwear sole and a method for forming the same. More particularly, the present invention relates to a textile-covered footwear sole and a method for forming a textile-covered footwear sole.

BACKGROUND INFORMATION

The literature is replete with descriptions of footwear and footwear soles. For example, U.S. Pat. No. 1,231,263 to Kelley describes a fleeced slipper sole having an outer member, which includes a stiffening layer inclosed between a pair of fabric or thin leather layers.

U.S. Pat. No. 1,795,305 to Jacob describes a slipper having a wearing sole stitched to a lining.

U.S. Pat. No. 3,800,445 to Greenblatt et al. describes a scuff slipper, which includes an outsole and an inner sole. A bead of the outsole is molded around the periphery of the inner sole to secure the inner sole to the outsole.

U.S. Pat. No. 3,930,275 to Bailin describes a method of fabricating a slipper. The slipper includes a sole having a substantially flat form and a die-cut boundary edge configuration generally corresponding to the shape of the human foot.

U.S. Pat. No. 4,295,238 to Clark describes a footwear article having a molded sole unit.

U.S. Pat. No. 4,571,851 to Yamada describes a disposable slipper formed of thick paper or corrugated cardboard.

U.S. Pat. No. 4,852,272 to Chilewich et al. describes a slipper sock construction. The slipper sock construction includes a knit sock, a flexible foam insert and a flexible sole. One surface of the foam insert is glued to the sole, and the other surface of the foam insert is glued to the outside surface of the knit sock. The foam insert, sole and knit sock are then sewn about the periphery of the foam insert and sole.

U.S. Pat. No. 4,858,337 to Barma describes a vulcanized rubber footwear product having an insole, a midsole affixed to the insole. An outer sole is secured to the midsole.

U.S. Pat. No. 4,899,412 to Ganon describes a slipper and a method of making a slipper. The slipper includes an outsole formed of a layer of terrycloth adhesively attached to a thin layer formed of a thin tissue-like material.

U.S. Pat. No. 5,033,144 to Ganon describes a slipper having an outsole pad formed of synthetic rubber.

U.S. Pat. Nos. 5,392,532 and 5,491,860 to Bray et al. describe a slipper having an insole attached to a peripheral outsole wall. The outsole is molded of a resilient material.

U.S. Pat. No. 5,515,566 to Ganon describe a moccasin construction having a sole liner and a sole.

U.S. Pat. No. 5,617,585 to Fons et al. describes a rubber soled slipper sock having a rubber sole liner.

U.S. Pat. No. 5,746,014 to Tanemoto describes a slipper having an upper sheet and a lower sheet adhered together to form a sole.

U.S. Pat. No. 5,983,527 to Strickland et al. describes a molded shoe assembly having an outer sole with a heat activatable adhesive coated on one surface and absorbed in the sole surface.

U.S. Pat. No. 5,992,054 to Rauch describes a shoe having an outsole, an insole and a sealing material injected between the outsole and the insole.

Finally, U.S. Pat. No. 6,035,555 to Pavelescu et al. describes a waterproof shoe having an outer layer and a monofilament netting sewn to the outer layer.

It is an object of the present invention to provide a footwear sole having improved wear resistance, improved slip resistance and/or improved traction. It is another object of the present invention to provide a footwear sole having an outer textile layer.

SUMMARY

The above and other beneficial objects of the present invention are most effectively attained by providing a footwear sole and a method for forming a footwear sole as described and claimed herein. In one embodiment, the footwear sole is formed of a rubber-like material having a textile layer at least partially impregnated into an outside surface of the rubber-like outer sole. The outer surface of the textile layer defines the outer surface of the footwear sole.

DETAILED DESCRIPTION

Figure 1:
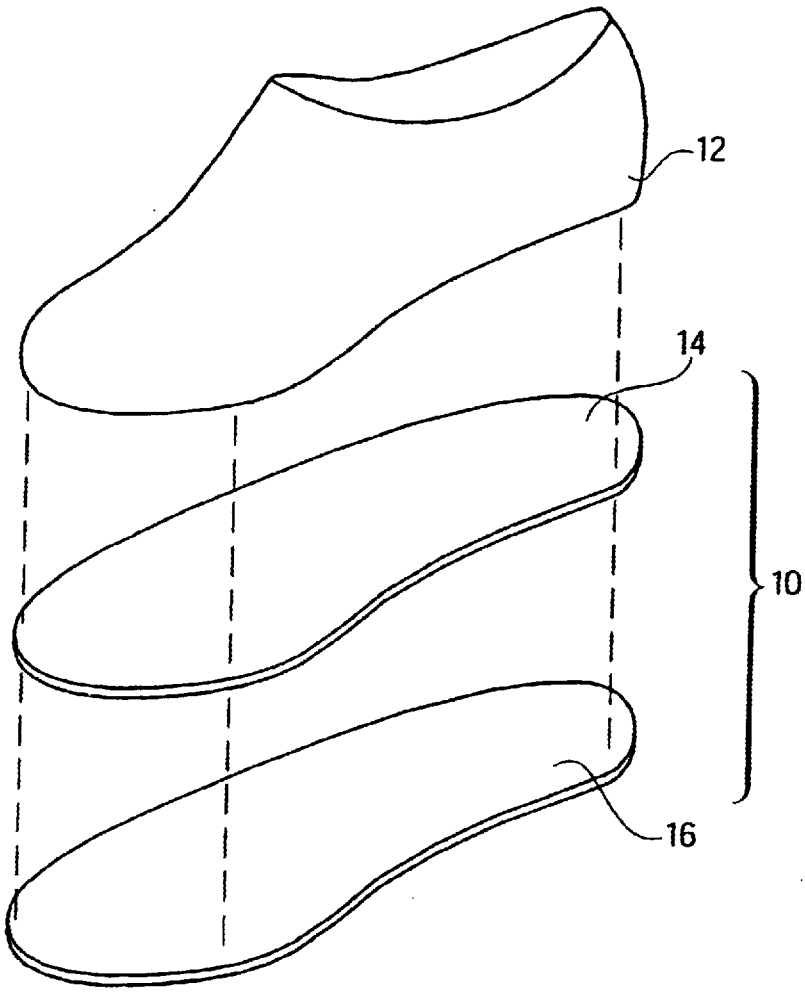
FIG. 1 is an exploded view of a footwear sole according to the present invention.

Those skilled in the art will gain an appreciation of the present invention from a reading of the following description when viewed in conjunction with the accompanying drawings of FIGS. 1–6B, inclusive. The individual reference characters designate the same or similar elements throughout the several views.

Referring now to FIG. 1, there is seen an exploded view of a footwear sole according to the present invention. Footwear sole 10 includes an inner sole 14 and an outer sole 16. Inner sole 14 is preferably formed of a rubber material or a 25 rubber-like and molded into appropriate shape and size according to conventional techniques. More preferably, inner sole 14 is formed of a TPR (thermoplastic rubber) material or polyvinyl chloride (PVC). Outer sole 16 is formed of a fabric material. Preferably, outer sole 16 is formed of a woven material and formed of natural fibers or a blend thereof. More particularly, outer sole 16 is formed of woven cotton. It should be appreciated, however, the outer sole 16 may be formed of any textile material. Also illustrated in FIG. 1 is a footwear article 12, which may be, for example, a slipper, a shoe, a boot or any other article of footwear.

Figure 2:
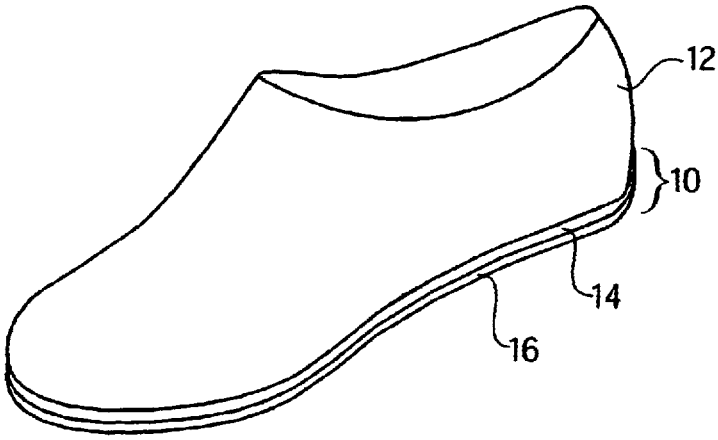
FIG. 2 is a side elevational view of the footwear sole illustrated in FIG. 1.

Referring now to FIG. 2, there is seen a side elevational view of the footwear sole illustrated in FIG. 1. As seen in FIG. 2, outer sole 16 defines the outer-most layer of the footwear article.

Figure 3A:
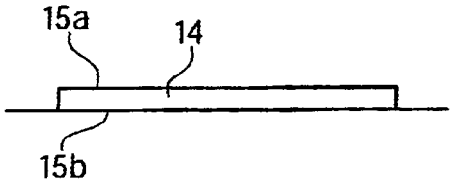
FIGS. 3A–3D illustrate a first manufacturing sequence for forming the footwear sole illustrated in FIGS. 1 and 2.
Figure 3B:
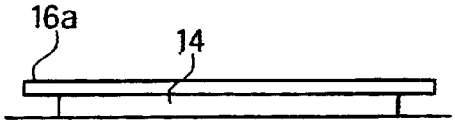
Figure 3C:
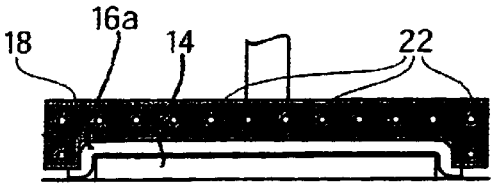
Figure 3D:
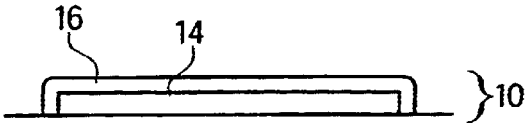

FIGS. 3A–3D illustrate a first manufacturing sequence for forming footwear sole 10. As indicated above, inner sole 14 is preferably formed of a rubber material according to conventional molding or other conventional forming techniques. FIG. 3A illustrates inner sole 14 as initially formed. One surface of inner sole 14 defines an outer surface 15*a*, and the opposite surface of inner sole 14 defines an inner surface 15*b*. Outer surface 15*a* may include knobs 20 or other skid-resistance, wear-resistance or traction-enhancing structures formed during the forming of the inner sole 14. As illustrated in FIG. 3B, a fabric layer 16*a* is placed upon the outer surface 15*a* of inner sole 14. As illustrated in FIG. 3C, a forming die 18 is pressed onto the fabric layer 16*a* and inner sole 14 to conform the fabric layer 16*a* to the shape of inner sole 14. Forming die 18 includes one or more heating elements 22, which are energized to heat the forming die 18. The forming die 18 thereby applies heat and pressure to the fabric layer 16*a* and the inner sole 14 to melt or at least soften at least an outer surface portion of inner sole 14. The melted or softened outer surface portion of inner sole 14 allows the fabric layer 16*a* to become at least partially impregnated into the inner sole 14, thereby securing the fabric layer 16*a* to inner sole 14. Thereafter, any excess portion of fabric layer 16*a* is removed and any excess portion of inner sole 14 is removed, thereby forming footwear sole 10 defined by inner sole 14 and outer sole 16, which is at least partially impregnated into inner sole 14. It should be appreciated that a plurality of inner soles 14 may be first formed, the fabric layer 16*a* placed over the plurality of inner soles 14 and the forming die 18 applied to the fabric layer 16*a* and the plurality of inner soles 14 to thereby simultaneously form a plurality of footwear soles 10. It should also be appreciated that the fabric layer 16*a* may be glued or otherwise applied to the inner sole 14 without the application of heat. It should be further appreciated that fabric layer 16*a* may be applied to the outer surface 15*a* of inner sole 14 while the inner sole 14, or at least the outer surface 15*a* thereof, is in a softened state immediately after forming the inner sole 14 before the same has cooled. By providing a fabric outer sole 16, the footwear sole 10 of the present invention provides increased wear resistance, increased slip resistance and/or improved traction. In addition, the footwear sole 10 of the present invention provides increased resistance to the scuffing of a floor by an exposed rubber footwear sole.

Figure 4A:
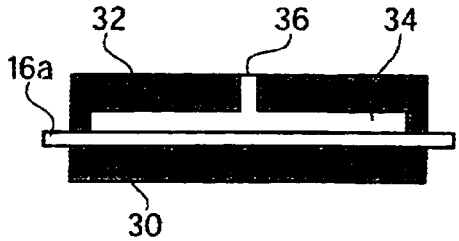
FIGS. 4A–4C illustrate a second manufacturing sequence for forming the footwear sole illustrated in FIGS. 1 and 2.
Figure 4B:
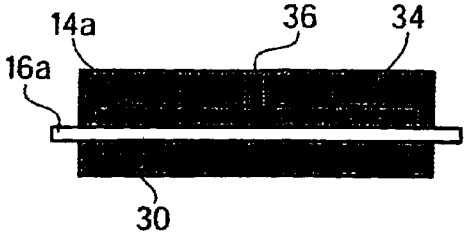
Figure 4C:
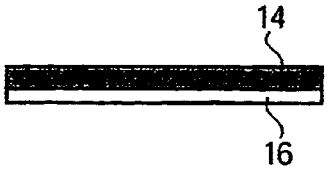

Referring now to FIGS. 4A–4C, there is seen a second manufacturing sequence for forming footwear sole 10. As seen in FIG. 4A, fabric layer 16*a* is first placed between first mold section 30 and second mold section 32. A cavity 34 is formed in second mold section 32 and defines the geometry of the inner sole 14. An injection port 36 is provided for injecting the material for forming the inner sole 14.

As seen in FIG. 4B, the inner sole material 14*a* is injected into the cavity 34 through the injection port 36 in a molten, fluid or at least softened state. A vent, not shown, may be provided to exhaust gases contained within the cavity while the material 14*a* is being injected into the cavity. The material 14*a* is absorbed, or impregnated, into the fabric material 16*a*. After the material 14*a* has sufficiently cooled and set, any excess material 14*a* and any excess fabric 16*a* is removed to thereby form inner sole 14 and outer sole 16 and, thus, footwear sole 10 as shown in FIG. 4C. As described above with respect to the first manufacturing sequence illustrated in FIGS. 3A–3D, a plurality of footwear soles 10 may be formed simultaneously.

Figure 5A:
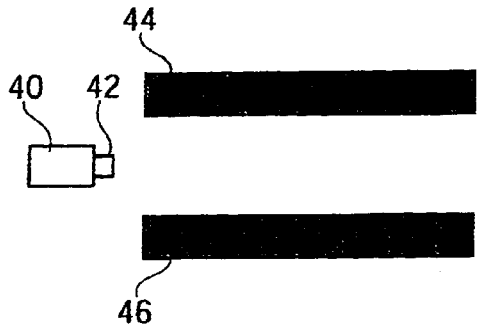
FIGS. 5A–5F illustrate a third manufacturing sequence for forming the footwear sole illustrated in FIGS. 1 and 2.
Figure 5D:
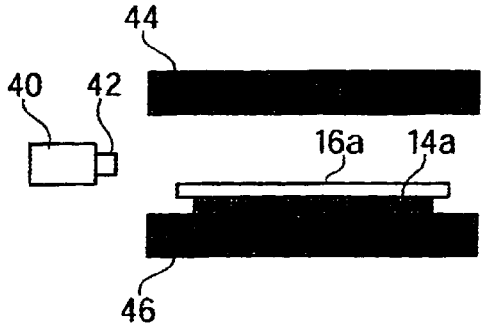
Figure 5B:
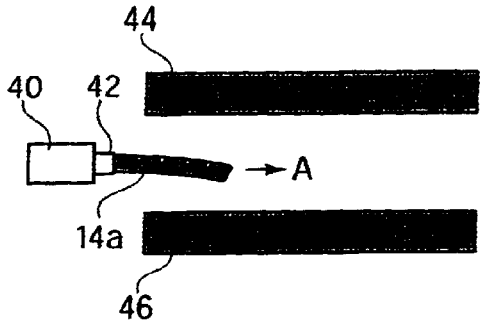
Figure 5E:
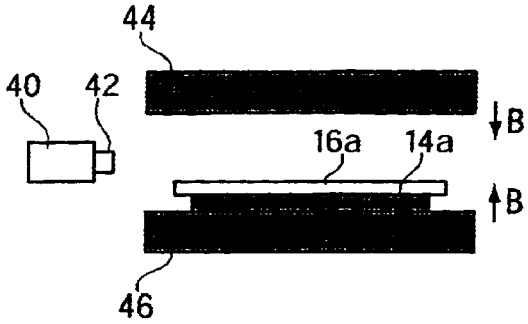
Figure 5C:
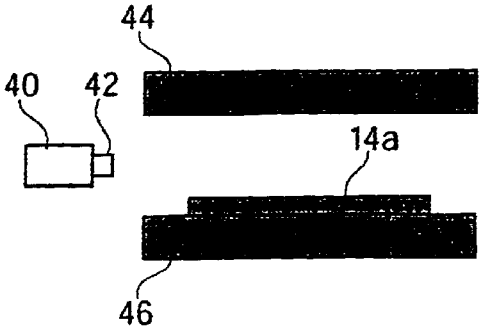

Referring now to FIGS. 5A–5E, there is seen a third manufacturing sequence for forming footwear sole 10. As seen in FIG. 5A, a device for forming footwear sole 10 includes an extruder 40, a first mold section 44 and a second mold section 46. The extruder 40 includes a nozzle 42 through which the inner sole material 14*a* is extruded. It should be appreciated that extrusion is but one exemplary way of delivering the inner sole material 14*a* to the mold sections 44, 46 and that the present invention is in no way limited thereby. As seen in FIG. 5B, the inner sole material 14*a* is extruded or otherwise delivered in the direction indicated by arrow A from the extruder 40 to the mold sections 44, 46. Once a sufficient quantity of inner sole material 14*a* is delivered to the mold sections 44, 46, the extrusion ceases. Thus, as seen in FIG. 5C, the inner sole material 14*a* is disposed between the mold sections 44, 46. Thereafter, as seen in FIG. 5D, outer sole material 16*a* is placed on one surface of the inner sole material 14*a*. It should be appreciated that the outer sole material 16*a* may be first placed between the mold sections 44, 46, and the inner sole material 14*a* extruded, or otherwise delivered, onto one surface of the outer sole material 16*a*. In either arrangement, the mold sections 44, 46 are thereafter brought together as shown in FIG. 5E by the arrows B, B. Heat and/or pressure are applied to the inner sole material 14*a* and the outer sole material 16*a* by at least one of the mold sections 44, 46.

Figure 5F:
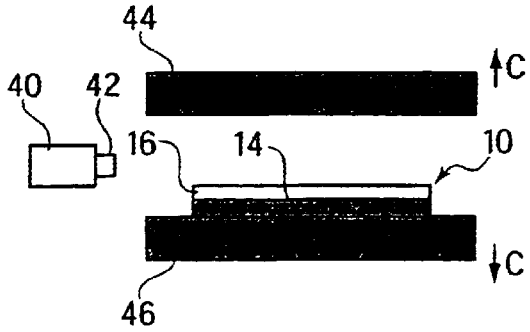

After the application of heat and/or pressure for sufficient time to form and set the inner sole material 14*a* and at least partially impregnate the outer sole material 16*a* into at least one surface of the inner sole material 14*a*, the mold sections 44, 46 are separated as shown in FIG. 5F by the arrows C, C. Thus, footwear sole 10 according to the present invention is formed.

Figure 6A:
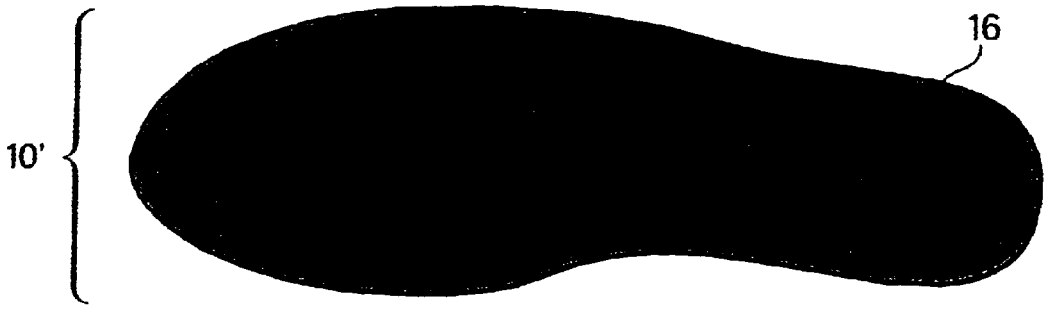
FIG. 6A is a bottom plan view of a first exemplary embodiment footwear sole according to the present invention.
Figure 6B:
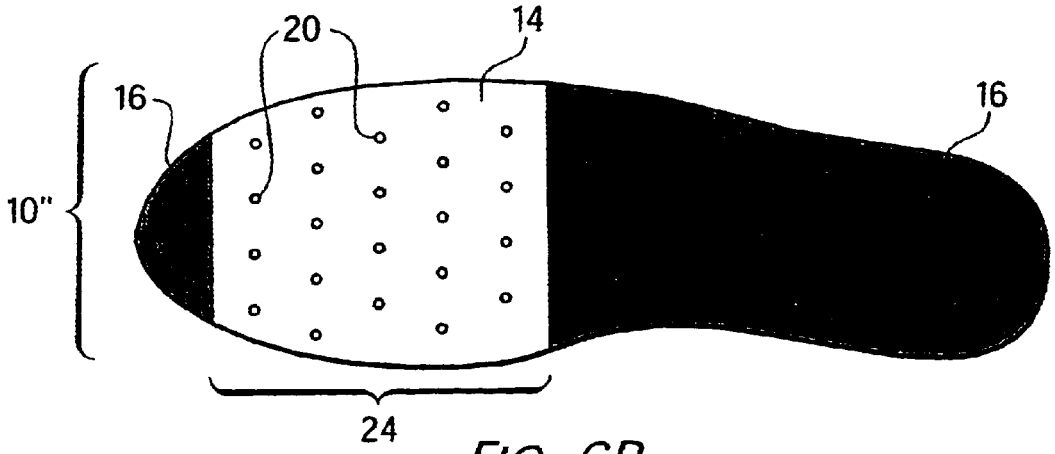
FIG. 6B is a bottom plan view of a second exemplary embodiment footwear sole according to the present invention.

Referring now to FIG. 6A, there is seen a first exemplary embodiment footwear sole 10' according to the present invention. As seen in FIG. 6A, outer sole 16 covers substantially the entire outer surface of inner sole 14. Alternatively, as illustrated in FIG. 6B, outer sole 16 may cover only a portion of the outer surface of inner sole 14. The second exemplary embodiment of footwear sole 10" illustrated in FIG. 6B includes a toe portion 24 of the inner sole 16 that is exposed.

That is, toe portion 24 does not include outer sole 16. It should be appreciated that the first and second embodiments of footwear sole 10', 10" are intended to be exemplary and that any single or multiple portion of inner sole 14 may be provided with or without outer sole 16.

Thus, the several aforementioned objects and advantages of the present invention are most effectively attained. Those skilled in the art will appreciated that many modifications of the preferred embodiments described hereinabove may be made without departing from the spirit and scope of the invention. Although several preferred embodiments of the invention have been described and disclosed in detail herein, it should be understood that this invention is in no sense limited thereby and that its scope is to be determined by that of the appended claims.

What is claimed is:

1. A sole for footwear, comprising:

an outer surface corresponding to an exterior peripheral face of the sole;

an inner sole; and an outer sole formed of a rubber-free, woven natural fiber textile material and partially impregnated into at least a portion of at least one surface of the inner sole so that only the textile material is exposed on the outer surface of the sole corresponding to the portion;

wherein the portion into which the outer sole is partially impregnated corresponds to less than the entire at least one surface of the inner sole so that only the inner sole is exposed on the outer surface of the sole corresponding to a remaining portion of the sole.

2. The sole according to claim 1, wherein the inner sole is formed of a rubber material.

3. The sole according to claim 1, wherein the inner sole is formed of a thermoplastic rubber material.

4. The sole according to claim 1, wherein the outer sole is formed of a blend of woven fibers.

5. A footwear article, comprising:

an outer surface corresponding to an exterior peripheral face of the footwear article;

an inner sole; and an outer sole formed of a rubber-free, woven natural fiber textile material and partially impregnated into at least a portion of at least one surface of the inner sole so that only the textile material is exposed on the outer surface of the footwear article corresponding to the portion;

wherein the portion into which the outer sole is partially impregnated corresponds to less than the entire at least one surface of the inner sole so that only the inner sole is exposed on the outer surface of the footwear article corresponding to a remaining portion of the sole.

6. The footwear article according to claim 5, wherein the inner sole is formed of a rubber material.

7. The footwear article according to claim 5, wherein the inner sole is formed of a thermoplastic rubber material.

8. The footwear article according to claim 5, wherein the outer sole is formed of a blend of woven fibers.

* * * * *